United States Patent [19]

Odagiri

[11] Patent Number: 4,760,564

[45] Date of Patent: Jul. 26, 1988

[54] ANALOG ELECTRONIC TIMEPIECE WITH CHARGING FUNCTION

[75] Inventor: Hiroshi Odagiri, Tokyo, Japan

[73] Assignee: Seiko Instruments Inc., Tokyo, Japan

[21] Appl. No.: 35,088

[22] Filed: Apr. 6, 1987

[30] Foreign Application Priority Data

Apr. 8, 1986 [JP] Japan ..... 61-80723

[51] Int. Cl.[4] ..... G04B 9/00; G04B 1/00

[52] U.S. Cl. ..... 368/66; 368/204; 368/205; 320/1

[58] Field of Search ..... 368/64, 66, 203–205; 320/1, 2, 11, 40

[56] References Cited

U.S. PATENT DOCUMENTS

| | | | |
|---|---|---|---|
| 4,240,021 | 12/1980 | Kashima et al. | 368/205 |
| 4,312,058 | 1/1982 | Shida et al. | 368/66 |
| 4,409,538 | 10/1983 | Tabata | 368/205 |
| 4,634,953 | 1/1987 | Shoji et al. | 368/205 |

*Primary Examiner*—Vit W. Miska

*Attorney, Agent, or Firm*—Bruce L. Adams; Van C. Wilks

[57] ABSTRACT

A timepiece has a stepping motor for intermittently rotating hands to indicate the time, a solar cell for temporarily generating electric charge and capacitors for storing the generated electric charge to supply an operating voltage. A drive circuit repeatedly applies a combination of first and second consecutive driving pulses having electric powers proportional to the operating voltage to the stepping motor, while a detector detects the operating voltage. A control circuit is connected between the drive circuit and the detector for controlling the detector to effect the operating voltage detection after the application of the first driving pulse and before the application of the following second driving pulse. When decrease of the operating voltage is detected after the application of the first driving pulse, the operating voltage is increased before the application of the following second driving pulse so as to ensure the rotation of the hands.

13 Claims, 2 Drawing Sheets

ANALOG ELECTRONIC TIMEPIECE WITH CHARGING FUNCTION

BACKGROUND OF THE INVENTION

1. Field of the Invention

This invention relates to a device for timing detection of supply voltage in an electronic timepiece of the self-power charging type having a means for generating electric energy which is stored as power source in capacitors.

2. Destcription of the Prior Art

One example of the connection diagram of a charging circuit element of an electronic timepiece with charging function employed heretofore is shown in FIG. 2.

Since the present invention relates to the rising time control of charging, first an operation in the initial state of charging will be described with reference to FIG. 2.

In the first state of charging, all of switches a, b and c are opened. The switches a, b and c are comprised of MOS transistors, respectively, for example. Accordingly, a capacitor 2 having a small capacity is charged with electric energy generated by a solar cell 1. When the terminal voltage of the capacitor 2 rises, an integrated circuit 3 begins to operate. This state is determined as a first state. When the potential of a terminal $Vc_2$ of the capacitor 2 exceeds a certain value after the integrated circuit begins to operate, the switch a is closed, and now the charging of a capacitor 4 of large capacity is started. This state is determined as a second state.

In the meantime, the integrated circuit 3 drives a step motor (not shown in the figure) to conduct a time keeping operation.

In the first and second states, accordingly, the integrated circuit 3 and the step motor are driven by the electric charge accumulated in the capacitor 2.

The capacity of the capacitor 2 used herein is set to be very small, about 6.8 $\mu$F, for instance, for the purpose of the quick start of operation.

The shift from the first state to the second state occurs when the absolute value of the terminal voltage $|Vc_2|$ of the capacitor 2 turns to be $2.0^V$ or above, for instance. If the solar cell 1 is shaded from the incident light for several seconds after the rise of $|Vc_2|$ above $2.0^V$ brings about the shift to the second state (2) the generated current is ceased.

Then the terminal voltage $|Vc_2|$ of the capacitor 2 falls to about $0.9^V$ after a few times of driving of the step motor.

If no measures were taken in this condition, $Vc_2$ would fall below the lowest operating voltage of the step motor, thereby causing the stop of operation or a failure in a rhythmical movement of the hand.

Even if the solar cell 1 were exposed again to the incident light thereafter, the terminal voltage $|Vc_2|$ of the capacitor 2 would rise very slowly since the large-capacity capacitor 4 is connected to the load of the solar cell 1. Consequently the stopped state of the timepiece would continue a long time.

The capacity of the large-capacity capacitor 4 used herein is set to be about 0.3 F, for instance.

Accordingly, it would take about 10 minutes for the generated current of 200 $\mu$A to raise the voltage of the large-capacity capacitor 4 from $0.9^V$ to $1.3^V$, for instance, which enables the operation. During this period, the timepiece could not be restarted.

In order to prevent the occurrence of these problems, the second potential of $Vc_2$ is detected in the state, and when $Vc_2$ falls below a certain value, the switch a is opened to restore the first state.

As the result, the solar cell 1 turns to be loaded only with the small-capacity capacitor 2, and therefore the terminal voltage $|Vc_2|$ of the capacitor 2 can be quickly raised in a short time.

Accordingly, such a switching operation is repeated between the first and second states in accordance with a balance between a generated energy and the consumed energy in the initial state of charging.

In this relation, the timing of detection of $Vc_2$ in second the state is particularly important. FIG. 3 shows a prior-art detection timing chart.

FIG. 3 shows the timing of a driving pulse in a compensative driving system in which a compensating or correction driving pulse $P_2$ of a large pulse width or large electric power is outputted when the step motor is not rotated by a main or normal driving pulse $P_1$ of a small pulse width or small electric power.

Such a compensative driving system is utilized for the electronic timepiece of the self charging type in order to reduce power consumption.

In the prior-art, the timing of detection of voltage is controlled after the end of driving of the step motor, as shown by a voltage detection pulse 12 in FIG. 3 (the polarity of the waveform 12 means nothing in particular). Diodes 7 and 8 are reverse-current check diodes which check an ineffective current bypassing the integrated circuit 3.

The switch b and the switch c are used in an advanced state of charging. These switches b and c will not be described herein, because they have no direct relation with the description of the present invention.

In the case when the detection of voltage is conducted after a compensating driving pulse $P_2$ is applied as shown in FIG. 3, it sometimes happens that the drive by the compensating pulse $P_2$ 11 can not be effected.

It is assumed, for instance, that the condition for the shift from the second state to the first state is $|Vc_2| \leqq 1.3^V$.

Furthermore, when $|Vc_2|$ is $1.3^V$ in the second and the pulse width of the main driving pulse $P_1$ is set to 4 ms, $|Vc_2|$ is lowered to about $1.05^V$ after the output of the main driving pulse $P_1$. If the step motor is not rotated by the normal pulse $P_1$ on the occasion and the lowest driving voltage thereof is $1.2^V$, the step motor is also not rotated by the following compensating driving pulse $P_2$; since the electric power of the compensating driving pulse $P_2$ is decreased in proportion to the terminal voltage $|Vc_2|$.

Thereafter, the condition $|Vc_2| \leqq 1.3^V$ is detected by the voltage detection pulse 12 and the shift is made from the second state to the first state. Then the potential of $Vc_2$ rises rapidly, so that an energy necessary for the following drives can be supplied. However, the first following drive also fails due to the failure of the preceding drive, thus resulting in a delay of two seconds.

SUMMARY OF THE INVENTION

The present invention is aimed to drive the step motor correctly even in such a case as described above.

In order to solve the above-described problem, the present invention is designed to detect the voltage between the main or normal driving pulse $P_1$ and the compensating or correction driving pulse $P_2$ so as to ensure the drive by the compensating driving pulse $P_2$.

The timing of a voltage detection pulse 13 is set, as shown in FIG. 4, between the main driving pulse $P_1$ 10 and the compensating driving pulse $P_2$ 11.

As the result, the first state is restored in response to the voltage detection executed before the application of compensating driving pulse $P_2$ 11, although the potential of $|Vc_2|$ fails once below the lowest operating voltage of the step motor, under the same condition as described above.

On the assumption that a time interval from the voltage detection to the output of the compensating driving pulse $P_2$ is 10 ms, for instance, and the generated current of 200 $\mu$A flows, $|Vc_2|$ can be restored from $1.05^V$ to about $1.31^V$ before the compensating driving pulse $P_2$ 11 is outputted.

Therefore, the step motor is driven normally by the compensating driving pulse $P_2$ 11.

DETAILED DESCRIPTION OF THE PREFERRED EMBODIMENT

An embodiment of the present invention will be described hereunder in conjunction with the drawings.

Figure 5:
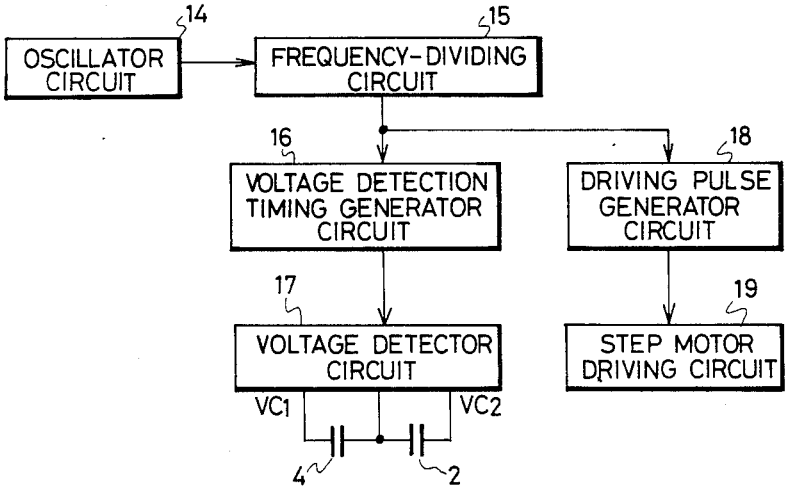
FIG. 5 is a block diagram showing schematically the structure of an integrated circuit.

FIG. 5 is a block diagram showing a schematic construction of an integrated circuit of the present invention.

A reference or clock signal oscillated by an oscillator circuit 14 is frequency-divided by a frequency-dividing circuit 15. An output signal of the frequency-dividing circuit 15 is supplied to a voltage detection timing generator circuit 16 and a driving pulse generator circuit 18.

A voltage detector circuit 17 detects the terminal or operating voltage $Vc_2$ and $Vc_1$ in response to a timing signal outputted from the voltage detection timing generator circuit 16.

The driving pulse generator circuit 18 delivers driving pulses to a step motor driving circuit 19. This circuit 19 detects the rotation and non-rotation of the step motor, while repeatedly driving the same, and requests the driving pulse generator circuit 18 for the compensating driving pulse $P_2$ on the occasion of the non-rotation detection.

Figure 1:
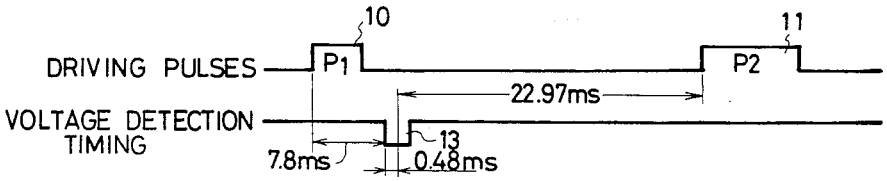
FIG. 1 shows the relationship between driving pulses and the timing of voltage detection according to the present invention.
Figure 2:
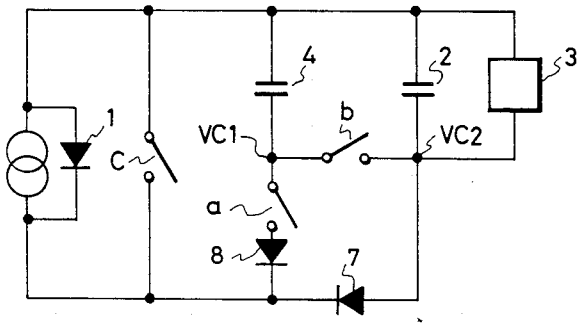
FIG. 2 is a connection diagram of a charging circuit of an electronic timepiece of the self charging type.
Figure 3:
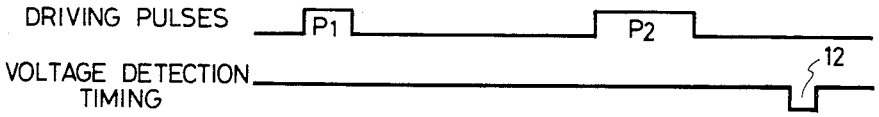
FIG.3 PRIOR ART
FIG. 3 shows the timing of voltage detection according to prior art.
Figure 4:
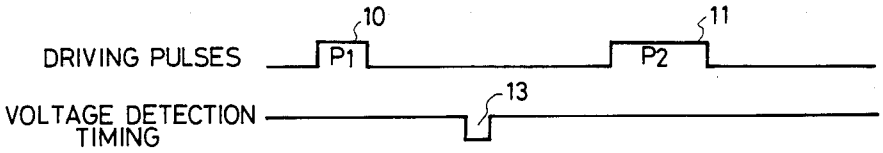
FIG. 4 shows the timing of voltage detection according to the present invention.

The relationship between the timing of an output signal of the voltage detection timing generator circuit 16 and the timing of output from the driving pulse generator circuit 18 is shown in FIG. 1.

For instance, the timing of a detection pulse of the voltage detector circuit 17, which is the output of the voltage detection timing generator circuit 16, is set between the applications of the combination of the consecutive normal and correction driving pulses $P_1$ and $P_2$ at 7.8 ms after the rise of the main driving pulse $P_1$ 10, while the timing for shifting from the second state to the first state in order to raise the operating voltage is set at 0.48 ms after the start of voltage detection. By these settings, a time interval of 22.97 ms is left for the output of the following compensating driving pulse $P_2$ 11 after the shift of the state.

A charge accumulated in the capacitor 2 in the above time period is 4.59 $\mu$c (micro-coulomb) when a charging current is 200 $\mu$A.

The charge of 4.59 $\mu$c can raise the terminal voltage $Vc_2$ of the capacitor 2 by about $0.67^V$ when the capacity of the capacitor 2 is 6.8 $\mu$F, for instance.

Accordingly, even when the terminal voltage $|Vc_2|$ of the capacitor 2 decreases sharply by the drive of the main driving pulse $P_1$, the potential of $Vc_2$ can be recovered before the time of the output of the following compensating driving pulse $P_2$, on condition that the solar cell is exposed to the incident light.

The present invention is effective not only for the compensative driving system, but also for a construction in which such a drive as battery life display is conducted.

Figure 6:
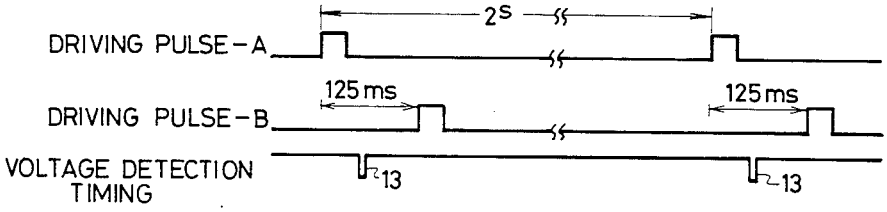
FIG. 6 shows driving waveforms and the timing of voltage detection in the case when the battery life display is conducted.

FIG. 6 shows a driving waveform in the case when the battery life display is conducted. In this case as well, it sometimes would happen that the second drive of two successive drives within a period of two seconds could not be effected if the detection of voltage were executed during a period of 1.825 second from the application of the first driving pulse-B to the application of the following driving pulse-A.

Therefore, the detection of voltage is designed to be conducted during a period of 125 ms which is a shorter interval of the two successive drive, as shown in FIG. 6.

As above described, it is necessary, for improving the quality of timepiece, to set the timing of voltage detection in the narrow interval of driving in the case of the analog electronic timepiece with charging function based on the compensative driving system or in the case of conducting the cell life display, which has drives conducted at a relatively long driving interval and at a relatively short driving interval.

It can be realized very easily to determine the timing of voltage detection from the output timing of the driving pulse generator circuit 18, by modifying the construction of a logic circuit of the voltage detection timing generator circuit 16.

As above described, in the case when there is a possibility of a step motor being driven at a shorter interval than an ordinary period of operation of hands as in the compensative driving system, the detection of voltage conducted within the short interval enables the compensation of the drive conducted just after the detection.

As the result, the probability of stoppage of a timepiece or a failure in a rhythmical or intermittent movement of the hand in the initial stage of charging can be reduced, and thus the quality of the electronic timepiece with charging function can be improved.

What is claimed is:

1. An analog electronic timepiece with charging function comprising:

a stepping motor;

an electric energy generating means for generating electric energy;

a plurality of capacitor means for accumulating the electric energy fed from the electric energy generating means;

a voltage detector circuit means for detecting terminal voltages of said plurality of capacitor means;

a driving pulse generator circuit means for applying a plurality of driving pulses to the step motor, said plurality of driving pulses including pulses generated at a relatively short time interval and pulses generated at a relatively long time interval; and a voltage detecting timing generator circuit means for determining a detection timing of said voltage detector circuit for the voltage detection to be carried out during the short time interval.

2. An analog electronic timepiece as claimed in claim 1; wherein the driving pulse generator circuit means includes means for generating a pair of pulses at a relatively short time interval in the form of a normal driving pulse having a relatively small pulse width and a compensating driving pulse having a relatively large pulse width outputted when the step motor is not rotated by the normal driving pulse.

3. An analog electronic timepiece as claimed in claim 1; wherein the driving pulse generator circuit means includes means for generating pulses for a relatively short time interval in the form of two normal driving pulses outputted when a battery life display is conducted.

4. An analog electronic timepiece as claimed in claim 1; wherein the electric energy generating means comprises a solar cell.

5. An analog electronic timepiece as claimed in claim 1; wherein said electric energy generating means comprises a manually operated generator.

6. An analog electronic timepiece as claimed in claim 1; wherein said plurality of capacitor means comprises a first capacitor having a relatively large capacity and being connected to or disconnected from said electric energy generating means according to the output of said voltage detector circuit means and a second capacitor having much smaller capacity than that of the first capacitor.

7. A timepiece comprising: a hand; a stepping motor for intermittently rotating the hand to indicate the time; generating means for temporarily generating electric charge; storing means for storing the generated electric charge to supply an operating voltage effective to operate the timepiece; drive means for repeatedly applying a combination of first and second consecutive driving pulses having electric powers proportional to the operating voltage to the stepping motor to thereby effect the intermittent rotation of the hand; detecting means for detecting the operating voltage; controlling means connected between the drive means and the detecting means for controlling the detecting means to effect the operating voltage detection after the application of the first driving pulse and before the application of the following second driving pulse; and increasing means provided in the storing means and operative when decrease of the operating voltage is detected after the application of the first driving pulse for increasing the operating voltage before the application of the following second driving pulse so as to ensure the rotation of the hand by the combination of the first and second driving pulses.

8. A timepiece as claimed in claim 7; wherein the generating means comprises a solar cell for generating electric charge when exposed to incident light.

9. A timepiece as claimed in claim 7; wherein the storing means comprises capacitive means connected to the generating means for storing therein the electric charge and producing the operating voltage across its terminals according to the amount of stored electric charge.

10. A timepiece as claimed in claim 9; wherein the capacitive means includes a pair of capacitors connected in parallel to each other, one of the capacitors having a relatively small capacity for quickly building up the operating voltage, the other of the capacitors having a relatively large capacity for backing up said one of the capacitors.

11. A timepiece as claimed in claim 10; wherein the increasing means comprises means responsive to the detection of the operating voltage for disconnecting the other of the capacitors from the generating means so that the generated electric charge is solely charged into said one of the capacitors to quickly raise the operating voltage.

12. A timepiece as claimed in claim 7; wherein the drive means includes means for producing the combination of first and second consecutive driving pulses in the form of a normal driving pulse having a relatively small electric power effective to normally drive the stepping motor and a following correction driving pulse having a relatively large electric power effective to drive the stepping motor when the preceding normal driving pulse has failed to drive the stepping motor.

13. A timepiece as claimed in claim 7; wherein the drive means includes means for producing the combination of first and second consecutive driving pulses in the form of a pair of driving pulses having the same electric power effective to quickly drive the stepping motor twice.

* * * * *